US011344777B2

(12) United States Patent
Wang

(10) Patent No.: US 11,344,777 B2
(45) **Date of Patent: *May 31, 2022**

(54) FOLDABLE BASKETBALL STAND

(71) Applicant: LIVEN SPORTS MFG. (Xiamen) Co., Ltd., Xiamen (CN)

(72) Inventor: Jen-Hung Wang, Taipei (TW)

(73) Assignee: LIVEN SPORTS MFG. (XIAMEN) CO., LTD., Xiamen (CN)

( * ) Notice: Subject to any disclaimer, the term of this patent is extended or adjusted under 35 U.S.C. 154(b) by 61 days.

This patent is subject to a terminal disclaimer.

(21) Appl. No.: 16/870,465

(22) Filed: May 8, 2020

(65) Prior Publication Data

US 2021/0346773 A1 Nov. 11, 2021

(51) Int. Cl.
*A63B 63/08* (2006.01)
*A63B 63/00* (2006.01)

(52) U.S. Cl.
CPC ..... *A63B 63/083* (2013.01); *A63B 2063/001* (2013.01); *A63B 2063/002* (2013.01); *A63B 2210/50* (2013.01); *A63B 2225/09* (2013.01)

(58) Field of Classification Search
CPC ..... A63B 63/083; A63B 2063/001; A63B 2210/50
See application file for complete search history.

(56) References Cited

U.S. PATENT DOCUMENTS 2,144,148 A * 1/1939 Gross ..... A63B 63/083 473/481
2,747,875 A * 5/1956 Martin ..... A63B 67/06 273/397
D222,978 S * 2/1972 Vinas ..... D21/705
D284,599 S * 7/1986 Cochran ..... D21/305
4,805,917 A * 2/1989 Cochran ..... A63B 47/025 273/397
5,133,546 A * 7/1992 Matherne ..... A63B 24/0021 273/375
5,246,225 A * 9/1993 Matherne ..... A63B 24/0021 273/375
5,312,099 A * 5/1994 Oliver, Sr. ..... A63B 63/083 473/433
5,692,976 A * 12/1997 Yu ..... A63B 63/083 273/397
5,803,841 A * 9/1998 Daskoski ..... A63B 69/0002 473/454

(Continued)

*Primary Examiner* — Laura Davison
(74) *Attorney, Agent, or Firm* — Muncy, Geissler, Olds & Lowe, PC

(57) ABSTRACT

A foldable basketball stand has at least one hoop on a rear surface of a backboard on an upper half of an upper portion of a front frame. A middle portion of left/right front rod of the front frame has a first and a second left/right joints respectively. Rear/front ends of a left-top rod and a left-bottom rod of a left frame are connected to a left-middle rod/the left-front rod respectively. Rear/front ends of a right-top rod and a right-bottom rod of a right frame are connected to a right-middle rod/the right-front rod respectively. Two ends of left/right supporting rod are connected to a middle portion of the left/right top rod and the left/right front rod respectively. An upper portion of a rear frame has a stop portion. Left/right sides of the rear frame are connected to the left/right middle rods through left/right connecting rods respectively.

2 Claims, 5 Drawing Sheets

(56) References Cited

U.S. PATENT DOCUMENTS 6,093,120 A * 7/2000 Luke, Jr. ..... A63B 69/0002 473/435
6,929,569 B1 * 8/2005 Wang ..... A63B 24/0021 473/433
7,247,105 B2 * 7/2007 Huntsberger ..... A63B 63/083 473/433
7,328,902 B1 * 2/2008 White ..... A63B 63/00 273/343
8,801,549 B2 * 8/2014 Leoni ..... A63B 63/00 473/478
9,533,210 B2 * 1/2017 Lee ..... A63B 71/023
10,201,736 B2 * 2/2019 Tsai ..... A63B 67/002
10,220,281 B2 * 3/2019 Luo ..... A63B 69/0071
10,603,559 B1 * 3/2020 Farley ..... A63B 69/002
D892,965 S * 8/2020 Davis ..... D22/113
10,813,447 B2 * 10/2020 Tsai ..... A47B 3/0913
2002/0068650 A1 * 6/2002 Wang ..... A63B 69/0071 473/479
2004/0058756 A1 * 3/2004 Huang ..... A63B 63/083 473/433
2005/0192126 A1 * 9/2005 Remaklus ..... A63B 67/02 473/447
2006/0148599 A1 * 7/2006 Haddix ..... A63B 63/00 473/535
2008/0081713 A1 * 4/2008 Huang ..... A63B 69/0071 473/481
2008/0252018 A1 * 10/2008 Chung ..... A63B 24/0021 273/402
2009/0227402 A1 * 9/2009 Chen ..... A63B 69/0071 473/481
2012/0015764 A1 * 1/2012 Tynes ..... A63B 63/008 473/439
2016/0023095 A1 * 1/2016 Nally ..... A63F 7/3055 273/343
2016/0144256 A1 * 5/2016 Lee ..... A63B 69/002 473/416
2020/0086193 A1 * 3/2020 Lu ..... A63B 69/0071

* cited by examiner

FOLDABLE BASKETBALL STAND

FIELD OF THE INVENTION

The present invention is related to a foldable basketball stand, especially a foldable basketball stand capable of quick disassembling and assembling, storage space saving, and easy to carry.

BACKGROUND OF THE INVENTION

A conventional outdoor basketball stand usually is composed of a backboard having a hoop and a supporting stand. For a basketball stand of a shooting machine used indoors, in order to have sufficient support strength, the length of the support frame between the hoop and the shooter is divided into two stages, so that after the basketball thrown by the shooter touches the hoop or the backboard, the basketball can roll rearward and downward through an inclined net surface, allowing the shooter to shoot continuously.

SUMMARY OF THE INVENTION

However, the above basketball stand is mainly fixed and assembled by several metal tubes and flat plates. The assembly process is slow. And the overall volume after assembled has been fixed. Due to the inconvenience of folding, it is not only inconvenient to carry but also occupies huge storage space. Accordingly, the present invention has developed a new design which may avoid the above described drawbacks, may take into account economic considerations. Therefore, the present invention then has been invented.

One object of the present invention is to provide a foldable basketball stand which can solve the problems of conventional basketball stand of slow assembly and disassembly speed and huge storage space occupied. The foldable basketball stand is a combination of the supporting rods and the connecting joints, which can achieve quick assembly and disassembly, and can effectively save storage space after disassembly and facilitate the carrying.

In order to achieve the purpose of the present invention, the present invention provides a foldable basketball stand which mainly comprises a front frame, a left frame, a right frame, a rear frame, and a net. The front frame comprises a top rod, a bottom rod, a left-front rod, and a right-front rod. The left-front rod has an upper portion, a middle portion and a lower portion. The right-front rod has an upper portion, a middle portion and a lower portion. Two ends of the top rod are connected to a top end of the upper portion of the left-front rod and a top end of the upper portion of the right-front rod respectively. Two ends of the bottom rod are connected to a bottom end of the lower portion of the left-front rod and a bottom end of the lower portion of the right-front rod respectively. A first left joint and a second left joint are disposed on the left-front rod between the upper portion and the middle portion of the left-front rod and between the middle portion and the lower portion of the left-front rod respectively. A first right joint and a second right joint are disposed on the right-front rod between the upper portion and the middle portion of the right-front rod and between the middle portion and the lower portion of the right-front rod respectively. The first left joint and the first right joint are left-right symmetrically disposed. The second left joint and the second right joint are left-right symmetrically disposed. An upper portion of the front frame is between the upper portion of the left-front rod and the upper portion of the right-front rod. A lower portion of the front frame is between the lower portion of the left-front rod and the lower portion of the right-front rod. A middle portion of the front frame is between the middle portion of the left-front rod and the middle portion of the right-front rod. The upper portion of the front frame has a rear side. The middle portion of the front frame has a rear side. The lower portion of the front frame has a rear side. A first left adapter is disposed on a rear side of a top end of the lower portion of the left-front rod. A second left adapter is disposed on a rear side of the bottom end of the lower portion of the left-front rod. A first right adapter is disposed on a rear side of a top end of the lower portion of the right-front rod. A second right adapter is disposed on a rear side of the bottom end of the lower portion of the right-front rod. The backboard is disposed on an upper half of the upper portion of the front frame, wherein a rear surface of the backboard has at least one hoop. The left frame comprises a left-top rod, a left-bottom rod, and a left-middle rod. A middle portion of the left-top rod is detachably connected to one end of a left supporting rod. The other end of the left supporting rod is detachably connected to the left-front rod above the first left joint. A rear end of the left-top rod is connected to a top end of the left-middle rod. A rear end of the left-bottom rod is connected to a bottom end of the left-middle rod through a left T-junction. A front end of the left-top rod is connected to the left-front rod through the first left adapter. A front end of the left-bottom rod is connected to the left-front rod through the second left adapter. The left frame has a left side and a right side. The right frame comprises a right-top rod, a right-bottom rod, and a right-middle rod. A middle portion of the right-top rod is detachably connected to one end of a right supporting rod. The other end of the right supporting rod is detachably connected to the right-front rod above the first right joint. A rear end of the right-top rod is connected to a top end of the right-middle rod. A rear end of the right-bottom rod is connected to a bottom end of the right-middle rod through a right T-junction. A front end of the right-top rod is connected to the right-front rod through the first right adapter. A front end of the right-bottom rod is connected to the right-front rod through the second right adapter. A left end of a middle connecting rod is detachably connected to the left frame through the left T-junction. A right end of the middle connecting rod is detachably connected to the right frame through the right T-junction. The right frame has a left side and a right side. The rear frame comprises a left-rear rod, a right-rear rod, an upper-top rod and a lower-top rod. The upper-top rod and the lower-top rod are parallel. A left end of the upper-top rod and a left end of the lower-top rod are each connected to the left-rear rod. A right end of the upper-top rod and a right end of the lower-top rod are each connected to the right-rear rod. The left-rear rod of the rear frame is detachably connected to a rear end of a left connecting rod. A front end of the left connecting rod is detachably connected to the left-middle rod. The right-rear rod of the rear frame is detachably connected to a rear end of a right connecting rod. A front end of the right connecting rod is detachably connected to the right-middle rod. A front end of the net is connected to the front frame, and a rear end of the net is connected to the rear frame. An inclined net surface is formed between the bottom end of the backboard and the lower-top rod of the rear frame. A stop portion is formed between the upper-top rod and the lower-top rod of the rear frame. The foldable basketball stand is capable of being transformed to a folded state by removing the left connecting rod, the right connecting rod, the middle connecting rod, the left supporting rod, the right supporting rod and the net; rotating the left frame counterclockwise relative to the first left adapter and the second left adapter and rotating the right frame clockwise relative to the first right adapter and the second right adapter, so that the left frame and the right frame are parallel to the lower portion of the front frame, and the right side of the left frame and the left side of the right frame are facing the rear side of the lower portion of the front frame; synchronously rotating the upper portion of the left-front rod relative to the first left joint and rotating the upper portion of the right-front rod relative to the first right joint, so that the upper portion of the front frame is perpendicular to the middle portion of the front frame; synchronously rotating the middle portion of the left-front rod relative to the second left joint and rotating the middle portion of the right-front rod relative to the second right joint, so that the middle portion of the front frame is perpendicular to the lower portion of the front frame, the rear side of the middle portion of the front frame is facing down, the upper portion of the front frame is parallel to the left frame, the right frame and the lower portion of the front frame, the rear side of the upper portion of the front frame is facing the left side of the left frame and the right side of the right frame, the left frame and the right frame are sandwiched by the lower portion and the upper portion of the front frame, wherein a height of the front frame is shorten when the foldable basketball stand is transformed to the folded state.

In implementation, the present invention further comprises a supporting rod. A top end and a bottom end of the supporting rod are detachably connected to the lower-top rod and the middle connecting rod respectively.

For further understanding the characteristics and effects of the present invention, some preferred embodiments referred to drawings are in detail described as follows.

DETAILED DESCRIPTIONS OF PREFERRED EMBODIMENTS

Figure 1:
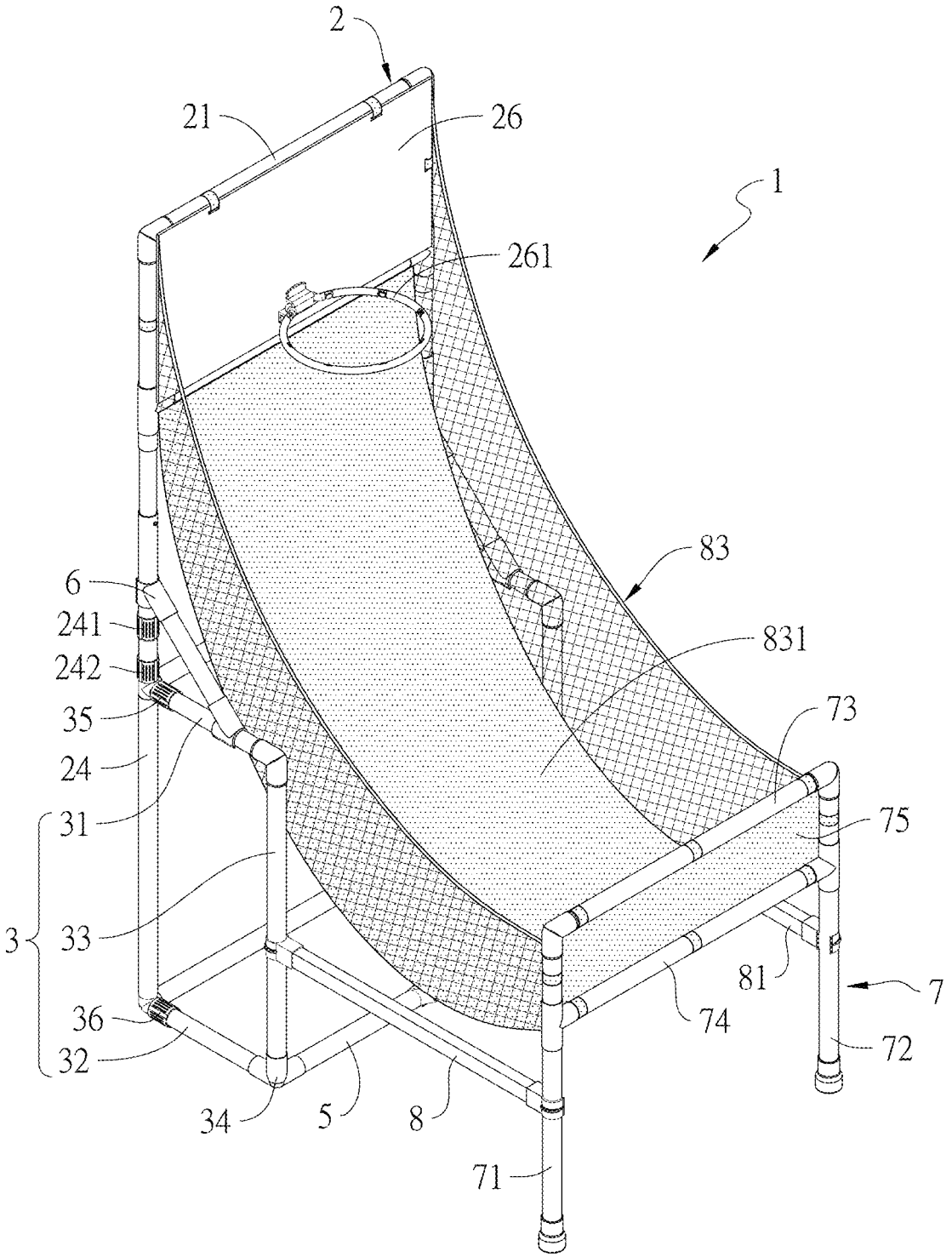
FIG. 1 is a perspective view of a preferred embodiment of the present invention provided with net.
Figure 2:
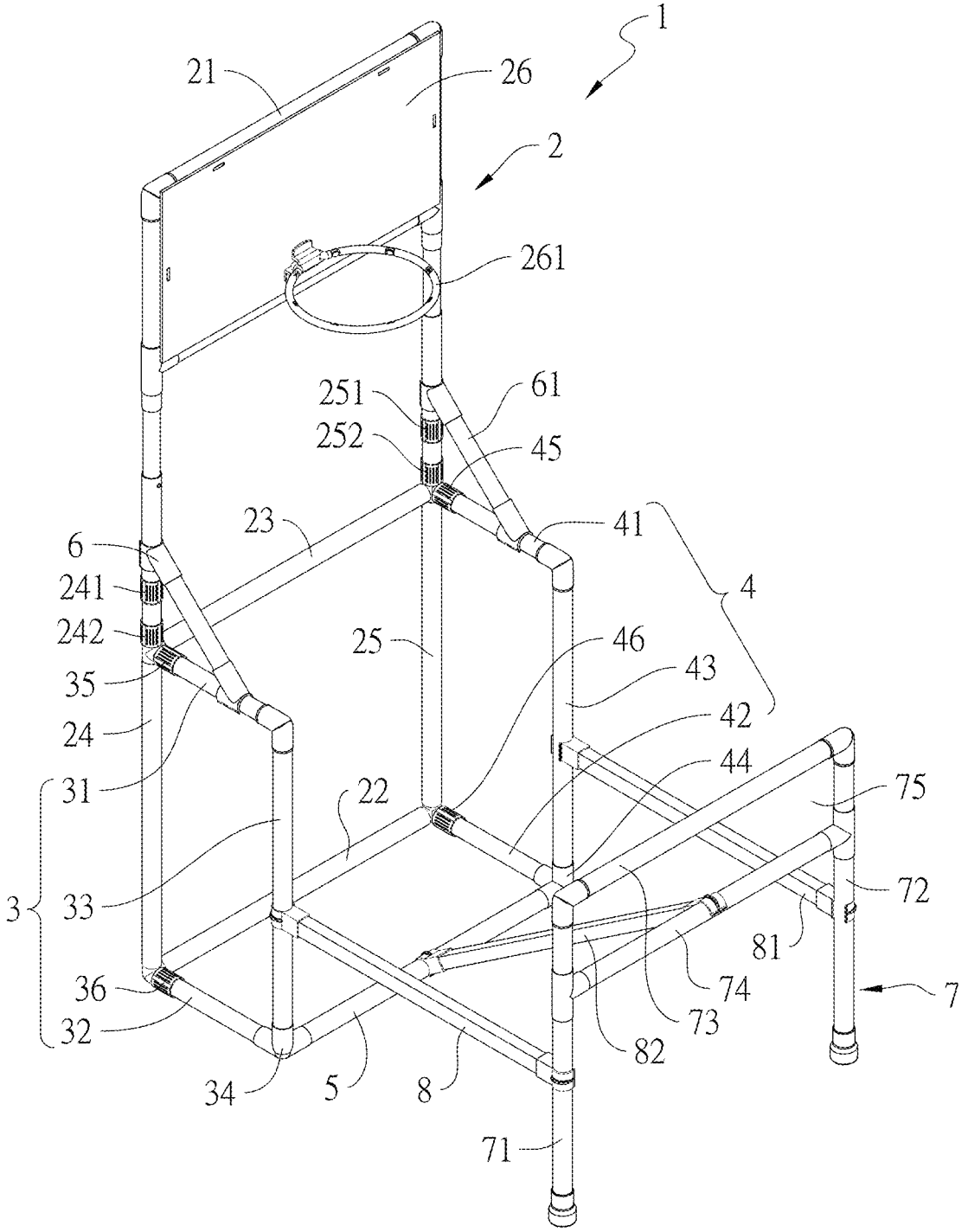
FIG. 2 is a perspective view of the preferred embodiment of the present invention.

Please refer to FIGS. 1 and 2, which are preferred embodiments of a foldable basketball stand 1 of the present invention. The foldable basketball stand 1 mainly comprises a front frame 2, a left frame 3, a right frame 4, a middle connecting rod 5, a left supporting rod 6, a right supporting rod 61, a rear frame 7, a left connecting rod 8, a right connecting rod 81, a supporting rod 82, and a net 83. One side of the foldable basketball stand 1 having a backboard 26 is defined as a front side of the foldable basketball stand 1, while a position where a shooter stands distant from the backboard 26 is defined as a rear side of the foldable basketball stand 1. And a left side and a right side of the foldable basketball stand 1 are defined respectively, by the direction in which a shooter faces the backboard 26.

The front frame 2 is an upstanding quadrangular frame, which comprises a top rod 21, a bottom rod 22, a middle cross rod 23, a left-front rod 24, and a right-front rod 25. An upper half of an upper portion of the front frame 2 is provided with the backboard 26. A rear surface of the backboard 26 has a hoop 261. In implementation, there may have two hoops 261 arranged horizontally at intervals on the rear surface of the backboard 26. The left-front rod 24 has an upper portion, a middle portion, and a lower portion. A first left joint 241 and a second left joint 242 are disposed on the left-front rod 24 between the upper portion of the left-front rod 24 and the middle portion of the left-front rod 24 and between the middle portion of the left-front rod 24 and the lower portion of the left-front rod 24 respectively. Similarly, the right-front rod 25 has an upper portion, a middle portion, and a lower portion. A first right joint 251 and a second right joint 252 are disposed on the right-front rod 25 between the upper portion of the right-front rod 25 and the middle portion of the right-front rod 25 and between the middle portion of the right-front rod 25 and the lower portion of the right-front rod 25 respectively. Two ends of the top rod 21 are connected to a top end of the upper portion of the left-front rod 24 and a top end of the upper portion of the right-front rod 25 respectively. Two ends of the bottom rod 22 are connected to a bottom end of the lower portion of the left-front rod 24 and a bottom end of the lower portion of the right-front rod 25 respectively. Two ends of the middle cross rod 23 are connected to a top end of the lower portion of the left-front rod 24 and a top end of the lower portion of the right-front rod 25 respectively. The first left joint 241 and the first right joint 251 are arranged in a left-right symmetrical manner; the second left joint 242 and the second right joint 252 are arranged in a left-right symmetrical manner. The upper portion of the front frame 2 is between the upper portion of the left-front rod 24 and the upper portion of the right-front rod 25. A lower portion of the front frame 2 is between the lower portion of the left-front rod 24 and the lower portion of the right-front rod 25. A middle portion of the front frame 2 is between the middle portion of the left-front rod 24 and the middle portion of the right-front rod 25. The upper portion of the front frame 2 has a rear side; the middle portion of the front frame 2 has a rear side; the lower portion of the front frame 2 has a rear side.

The left frame 3 is an upstanding rectangular frame, which comprises a left-top rod 31, a left-bottom rod 32 and a left-middle rod 33. A rear end of the left-top rod 31 is connected to a top end of the left-middle rod 33. A rear end of the left-bottom rod 32 is connected to a bottom end of the left-middle rod 33 through a left T-junction 34. A first left adapter 35 (a joint) is disposed on a rear side of the top end of the lower portion of the left-front rod 24, wherein a front end of the left-top rod 31 is connected to the left-front rod 24 through the first left adapter 35. In implementation, the first left adapter 35 may also be a T-shape collar sleeved on the left-front rod 24. A second left adapter 36 (a joint) is disposed on a rear side of the bottom end of the lower portion of the left-front rod 24. A front end of the left-bottom rod 32 is connected to the left-front rod 24 through the second left adapter 36. In implementation, the second left adapter 36 may also be a T-shape collar sleeved on the bottom end of the left-front rod 24. The left frame 3 has a left side and a right side. The left supporting rod 6 is a connecting rod arranged in an inclined manner. A bottom end and a top end of the left supporting rod 6 are C-shaped collars respectively. The bottom end of the left supporting rod 6 is detachably sleeved on a middle portion of the left-top rod 31. The top end of the left supporting rod 6 is detachably sleeved on the left-front rod 24 above the first left joint 241.

The right frame 4 is an upstanding rectangular frame. The right frame 4 and the left frame 3 are symmetrical with respect to the right side and the left side of the front frame 2. The right frame 4 comprises a right-top rod 41, a right-bottom rod 42, and a right-middle rod 43. A rear end of the right-top rod 41 is connected to a top end of the right-middle rod 43. A rear end of the right-bottom rod 42 is connected to a bottom end of the right-middle rod 43 through a right T-junction 44. A first right adapter 45 (a joint) is disposed on a rear side of the top end of the lower portion of the right-front rod 25, wherein a front end of the right-top rod 41 is connected to the right-front rod 25 through the first right adapter 45. In implementation, the first right adapter 45 may also be a T-shape collar sleeved on the right-front rod 25. A second right adapter 46 (a joint) is disposed on a rear side of the bottom end of the lower portion of the right-front rod 25. A front end of the right-bottom rod 42 is connected to the right-front rod 25 through the second right adapter 46. In implementation, the second right adapter 46 may also be a T-shape collar sleeved on the bottom end of the right-front rod 25. The right frame 4 has a left side and a right side. The right supporting rod 61 is a connecting rod arranged in an inclined manner. The right supporting rod 61 and the left supporting rod 6 are symmetrical with respect to the right side and the left side of the front frame 2. A bottom end and a top end of the right supporting rod 61 are C-shaped collars respectively. The bottom end of the right supporting rod 61 is detachably sleeved on a middle portion of the right-top rod 41. The top end of the right supporting rod 61 is detachably sleeved on the right-front rod 25 above the first right joint 251.

A left end of the middle connecting rod 5 is detachably connected to the bottom end of the left-middle rod 33 through the left T-junction 34. A right end of the middle connecting rod 5 is detachably connected to the bottom end of the right-middle rod 43 through the right T-junction 44. A length of the middle connecting rod 5 is slightly longer than a distance between a port of the left T-junction 34 and a port of the right T-junction 44, so that, by the left-right movement, the left end and the right end of the middle connecting rod 5 are detachably connected to the left-middle rod 33 and the right-middle rod 43 respectively.

The rear frame 7 is an upstanding rectangular frame. The rear frame 7 comprises a left-rear rod 71, a right-rear rod 72, an upper-top rod 73, and a lower-top rod 74. A middle portion of the left-rear rod 71 is detachably connected to a C-shaped collar of a rear end of the left connecting rod 8. A C-shaped collar of a front end of the left connecting rod 8 is detachably connected to the left-middle rod 33. A middle portion of the right-rear rod 72 is detachably connected to a C-shaped collar of a rear end of the right connecting rod 81. A C-shaped collar of a front end of the right connecting rod 81 is detachably connected to the right-middle rod 43. The upper-top rod 73 and the lower-top rod 74 are parallel. A left end of the upper-top rod 73 is connected to a top end of an upper portion of the left-rear rod 71 through an elbow. A right end of the upper-top rod 73 is connected to a top end of an upper portion of the right-rear rod 72 through another elbow. A left end of the lower-top rod 74 is connected to the upper portion of the left-rear rod 71 through a T-shaped tube. A right end of the lower-top rod 74 is connected to the upper portion of the right-rear rod 72 through another T-shape tube. A top end and a bottom end of the supporting rod 82 are C-shaped collars respectively. The bottom end of the supporting rod 82 is detachably sleeved on a middle portion of the middle connecting rod 5. The top end of the supporting rod 82 is detachably sleeved on a middle portion of the lower-top rod 74.

The net 83 is connected to an outer peripheral edge of the foldable basketball stand 1 to form a block below the backboard 26 of the front frame 2 and the left side and the right side of the foldable basketball stand 1 respectively (a front end of the net 83 is connected to the front frame 2, a rear end of the net 83 is connected to the rear frame 7), and to form an inclined net surface 831 between the bottom end of the backboard 26 of the front frame 2 and the lower-top rod 74 of the rear frame 7. After the basketball thrown by the shooter touches the hoop 261 or the backboard 26, the basketball can roll rearward and downward. A stop portion 75 formed between the upper-top rod 73 and the lower-top rod 74 of the rear frame 7 can stop the rolling of the basketball and store a plurality of basketballs.

Figure 3:
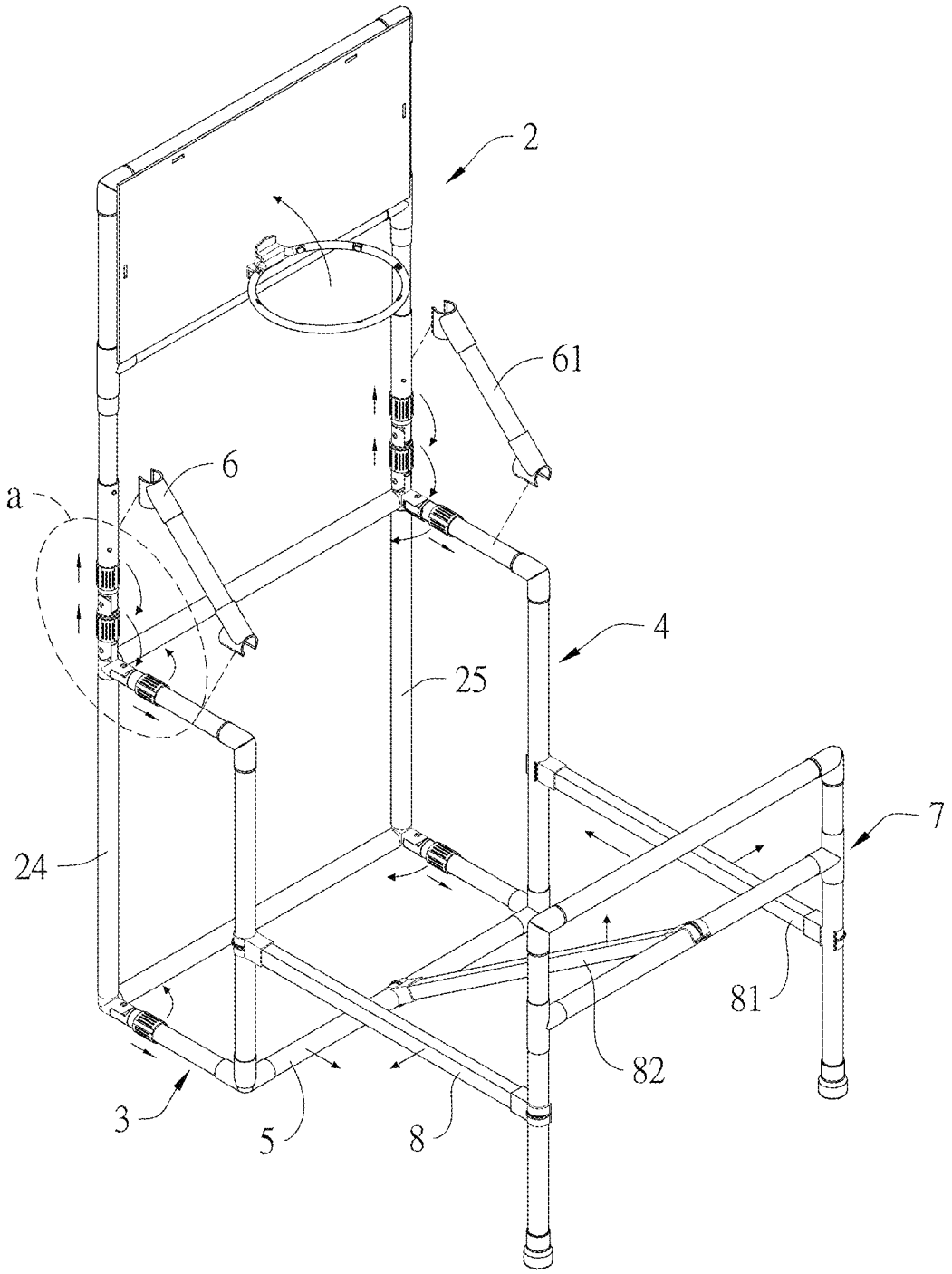
FIG. 3 is a schematic use state view of the preferred embodiment of the present invention in a to-be-folded state.
Figure 4:
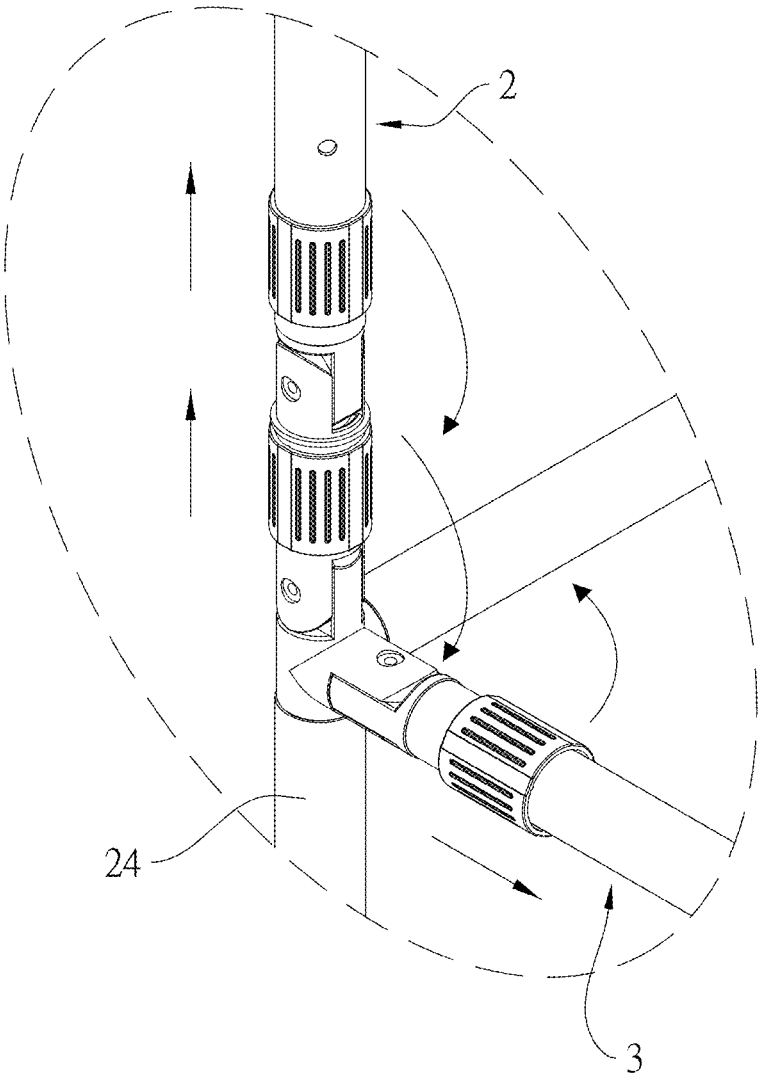
FIG. 4 is a partial enlargement view of portion a of FIG. 3.
Figure 5:
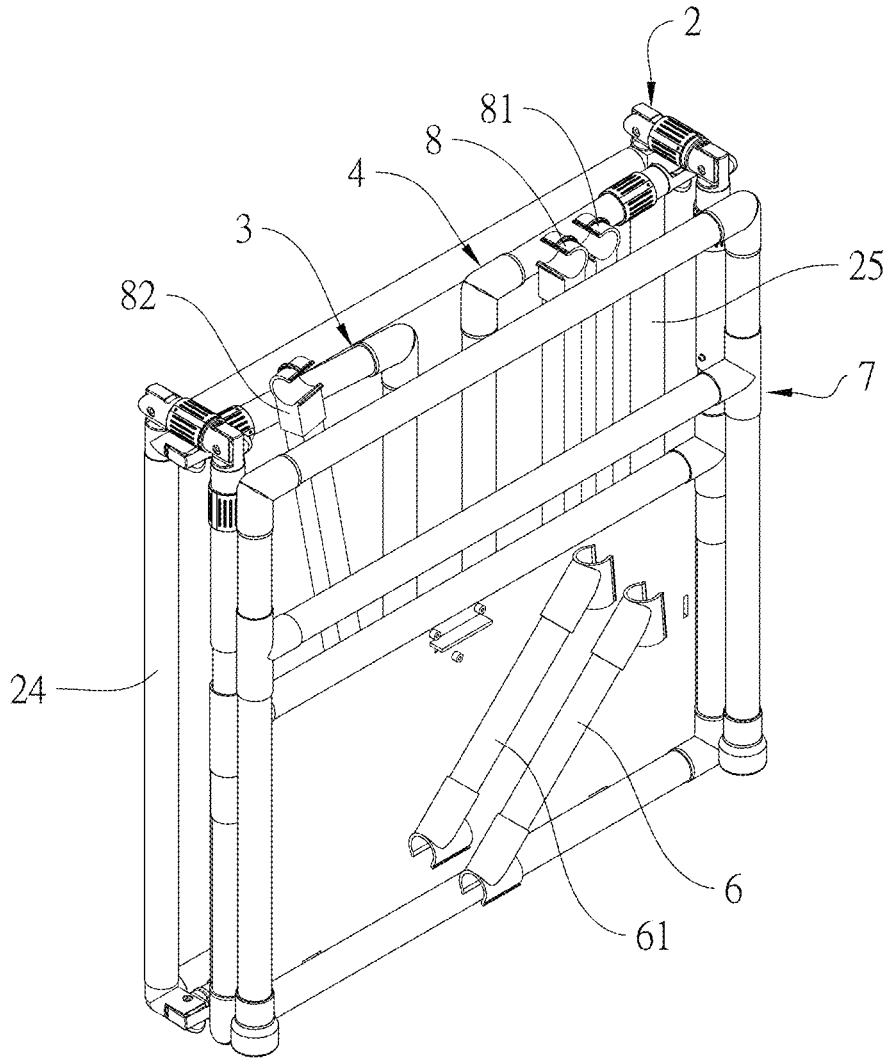
FIG. 5 is a perspective view of the preferred embodiment of the present invention in a folded state.

Therefore, as shown in FIGS. 3-5, the foldable basketball stand 1 of the present invention is capable of being transformed to a folded state through following steps of: removing the net 83; disassembling the rear frame 7 by removing the left connecting rod 8, the right connecting rod 81, and the supporting rod 82, and then removing the middle connecting rod 5, the left supporting rod 6, and the right supporting rod 61 (so that the middle connecting rod 5, the left supporting rod 6, and the right supporting rod 61 are separated from the foldable basketball stand 1); rotating the left frame 3 counterclockwise relative to the first left adapter 35 and the second left adapter 36 (that is, rotating the left frame 3 counterclockwise relative to the left-front rod 24) and rotating the right frame 4 clockwise relative to the first right adapter 45 and the second right adapter 46 (that is, rotating the right frame 4 clockwise relative to the right-front rod 25), so that the left-top rod 31 and the right-top rod 41 are parallel to the middle cross rod 23, the left-bottom rod 32 and the right-bottom rod 42 are parallel to the bottom rod 22, the left frame 3 and the right frame 4 are parallel to the lower portion of the front frame 2, and the right side of the left frame 3 and the left side of the right frame 4 are facing the rear side of the lower portion of the front frame 2; synchronously rotating the upper portion of the left-front rod 24 relative to the first left joint 241 and rotating the upper portion of the right-front rod 25 relative to the first right joint 251, so that the upper portion of the left-front rod 24 is perpendicular to the middle portion of the left-front rod 24, the upper portion of the right-front rod 25 is perpendicular to the middle portion of the right-front rod 25, the upper portion of the front frame 2 is perpendicular to the middle portion of the front frame 2, the rear side of the upper portion of the front frame 2 is facing down; synchronously rotating the middle portion of the left-front rod 24 relative to the second left joint 242 and rotating the middle portion of the right-front rod 25 relative to the second right joint 252, so that the middle portion of the left-front rod 24 is perpendicular to the lower portion of the left-front rod 24, the middle portion of the right-front rod 25 is perpendicular to the lower portion of the right-front rod 25, the middle portion of the front frame 2 is perpendicular to the lower portion of the front frame 2, the rear side of the middle portion of the front frame 2 is facing down, the upper portion of the front frame 2 is parallel to the left frame 3, the right frame 4 and the lower portion of the front frame 2, the rear side of the upper portion of the front frame 2 is facing the left side of the left frame 3 and the right side of the right frame 4, so that a height of the front frame 2 can be shortened, and the left frame 3 and the right frame 4 are sandwiched by the lower portion and the upper portion of the front frame 2.

In summary, as disclosed in the above description and attached drawings, the present invention can indeed achieve the intended object. It can provide a folded basketball stand made by the combination of the supporting rods and connecting joints, which can achieve quick assembly and disassembly, and can effectively save storage space after disassembly and facilitate the carrying. It is new and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A foldable basketball stand, wherein one side of said foldable basketball stand having a backboard is defined as a front side of said foldable basketball stand, a position where a shooter stands distant from said backboard is defined as a rear side of said foldable basketball stand; and a left side and a right side of said foldable basketball stand are defined respectively, by a direction in which said shooter faces said backboard, said foldable basketball stand comprises:

a front frame, which comprises a top rod, a bottom rod, a left-front rod, and a right-front rod, wherein said left-front rod has an upper portion, a middle portion and a lower portion, said right-front rod has an upper portion, a middle portion and a lower portion, two ends of said top rod are connected to a top end of said upper portion of said left-front rod and a top end of said upper portion of said right-front rod respectively, two ends of said bottom rod are connected to a bottom end of said lower portion of said left-front rod and a bottom end of said lower portion of said right-front rod respectively, a first left joint and a second left joint are disposed on said left-front rod between said upper portion and said middle portion of said left-front rod and between said middle portion and said lower portion of said left-front rod respectively, a first right joint and a second right joint are disposed on said right-front rod between said upper portion and said middle portion of said right-front rod and between said middle portion and said lower portion of said right-front rod respectively, said first left joint and said first right joint are left-right symmetrically disposed, said second left joint and said second right joint are left-right symmetrically disposed, an upper portion of said front frame is between said upper portion of said left-front rod and said upper portion of said right-front rod, a lower portion of said front frame is between said lower portion of said left-front rod and said lower portion of said right-front rod, a middle portion of said front frame is between said middle portion of said left-front rod and said middle portion of said right-front rod, said upper portion of said front frame has a rear side, said middle portion of said front frame has a rear side, said lower portion of said front frame has a rear side, a first left adapter is disposed on a rear side of a top end of said lower portion of said left-front rod, a second left adapter is disposed on a rear side of said bottom end of said lower portion of said left-front rod, a first right adapter is disposed on a rear side of a top end of said lower portion of said right-front rod, a second right adapter is disposed on a rear side of said bottom end of said lower portion of said right-front rod, said backboard is disposed on an upper half of said upper portion of said front frame, wherein a rear surface of said backboard has at least one hoop;

a left frame, which comprises a left-top rod, a left-bottom rod, and a left-middle rod, wherein a middle portion of said left-top rod is detachably connected to one end of a left supporting rod, the other end of said left supporting rod is detachably connected to said left-front rod above said first left joint, a rear end of said left-top rod is connected to a top end of said left-middle rod, a rear end of said left-bottom rod is connected to a bottom end of said left-middle rod through a left T-junction, wherein a front end of said left-top rod is connected to said left-front rod through said first left adapter, a front end of said left-bottom rod is connected to said left-front rod through said second left adapter, said left frame has a left side and a right side;

a right frame, which comprises a right-top rod, a right-bottom rod, and a right-middle rod, wherein a middle portion of said right-top rod is detachably connected to one end of a right supporting rod, the other end of said right supporting rod is detachably connected to said right-front rod above said first right joint, a rear end of said right-top rod is connected to a top end of said right-middle rod, a rear end of said right-bottom rod is connected to a bottom end of said right-middle rod through a right T-junction, wherein a front end of said right-top rod is connected to said right-front rod through said first right adapter, a front end of said right-bottom rod is connected to said right-front rod through said second right adapter, wherein a left end of a middle connecting rod is detachably connected to said left frame through said left T-junction, a right end of said middle connecting rod is detachably connected to said right frame through said right T-junction, said right frame has a left side and a right side;

a rear frame having a left-rear rod, a right-rear rod, an upper-top rod and a lower-top rod, wherein said upper-top rod and said lower-top rod are parallel, wherein a left end of said upper-top rod and a left end of the lower-top rod are each connected to said left-rear rod, wherein a right end of said upper-top rod and a right end of said lower-top rod are each connected to said right-rear rod, wherein said left-rear rod of said rear frame is detachably connected to a rear end of a left connecting rod, a front end of said left connecting rod is detachably connected to said left-middle rod, said right-rear rod of said rear frame is detachably connected to a rear end of a right connecting rod, and a front end of said right connecting rod is detachably connected to said right-middle rod; and a net, wherein a front end of said net is connected to said front frame, a rear end of said net is connected to said rear frame, an inclined net surface is formed between said bottom end of said backboard and said lower-top rod of said rear frame, and a stop portion is formed between said upper-top rod and said lower-top rod of said rear frame;

wherein said foldable basketball stand is capable of being transformed to a folded state by removing said net; removing said left connecting rod and said right connecting rod, so that said rear frame is separated from said foldable basketball stand; removing said middle connecting rod, said left supporting rod and said right supporting rod, so that said middle connecting rod, said left supporting rod and said right supporting rod are separated from said foldable basketball stand; rotating said left frame counterclockwise relative to said first left adapter and said second left adapter and rotating said right frame clockwise relative to said first right adapter and said second right adapter, so that said left frame and said right frame are parallel to said lower portion of said front frame, and said right side of said left frame and said left side of said right frame are facing said rear side of said lower portion of said front frame; synchronously rotating said upper portion of said left-front rod relative to said first left joint and rotating said upper portion of said right-front rod relative to said first right joint, so that said upper portion of said front frame is perpendicular to said middle portion of said front frame; and synchronously rotating said middle portion of said left-front rod relative to said second left joint and rotating said middle portion of said right-front rod relative to said second right joint, so that said middle portion of said front frame is perpendicular to said lower portion of said front frame, said rear side of said middle portion of said front frame is facing down, said upper portion of said front frame is parallel to said left frame, said right frame and said lower portion of said front frame, said rear side of said upper portion of said front frame is facing said left side of said left frame and said right side of said right frame, said left frame and said right frame are sandwiched by said lower portion and said upper portion of said front frame, wherein a height of said front frame is shortened when said foldable basketball stand is transformed to said folded state.

2. The foldable basketball stand according to claim 1, further comprising a supporting rod, wherein a top end and a bottom end of said supporting rod are detachably connected to said lower-top rod and said middle connecting rod respectively.

* * * * *